United States Patent [19]

Schoppee

[11] 4,073,123

[45] Feb. 14, 1978

[54] WRAPPING MACHINE

[75] Inventor: Lawrence W. Schoppee, Springfield, Mass.

[73] Assignee: Package Machinery Company, East Longmeadow, Mass.

[21] Appl. No.: 702,036

[22] Filed: July 2, 1976

Related U.S. Application Data

[63] Continuation-in-part of Ser. No. 606,236, Aug. 20, 1975, abandoned.

[51] Int. Cl.[2] ..... B65B 11/32

[52] U.S. Cl. ..... 53/234; 53/388

[58] Field of Search ..... 53/77, 225, 226, 233, 53/234, 388, 176, 375; 156/380; 432/45, 46

[56] References Cited

U.S. PATENT DOCUMENTS

| | | | |
|---|---|---|---|
| 467,040 | 1/1892 | Mellen | 53/234 X |
| 1,109,461 | 9/1914 | Price | 53/234 X |
| 1,187,055 | 6/1916 | Ferguson | 53/234 X |
| 1,359,181 | 11/1920 | Lietz | 53/234 |
| 1,474,181 | 11/1923 | Steere | 53/176 X |
| 1,485,598 | 3/1934 | Croxford | 53/234 |
| 1,875,975 | 9/1932 | Alm | 53/388 X |
| 1,946,697 | 2/1934 | Johnson et al. | 53/234 |
| 2,006,711 | 7/1935 | Farmer et al. | 53/77 X |
| 2,196,666 | 4/1940 | Moore | 53/234 X |
| 2,234,175 | 3/1941 | Jackson | 53/379 X |
| 2,276,744 | 3/1942 | Smith et al. | 53/234 |
| 2,603,047 | 7/1952 | Malhiot | 53/234 X |
| 3,405,505 | 10/1968 | Mistarz | 53/375 X |
| 3,628,309 | 12/1971 | Seragnoli | 53/234 X |
| 3,948,115 | 4/1976 | Seragnoli | 53/234 X |

*Primary Examiner*—Othell M. Simpson
*Assistant Examiner*—John Sipos
*Attorney, Agent, or Firm*—McCormick, Paulding & Huber

[57] ABSTRACT

A machine for wrapping articles of substantially rectangular parallelepiped form comprises a first tumble box which partially forms a wrapper to a generally U-shaped configuration about an article, a long seam heater which cooperates with the first tumble box to complete the initial wrapping operation and seals the long seam of the wrapper, and second, third, and fourth tumble boxes which tuck and fold the ends of the wrapper inwardly against opposite end of the article and complete the wrapping operation. Each tumble box has an ejector mechanism operated by a rack and gear segment. The long seam heater has means for dumping articles therefrom when the machine stops for any reason. Package ends folds are made while the partially wrapped article is held substantially square by a tumble box. Another machine for wrapping a product which comprises individual pieces standing on edge and arranged in end-to-end relation utilizes three tumble boxes and a long seam heater. The tumble boxes and seam heater cooperate to retain opposite ends of the partially wrapped product as it advances through the wrapping machine. Final end folds are made while the partially wrapped product is held substantially square by a tumble box.

33 Claims, 16 Drawing Figures

FIG. 9
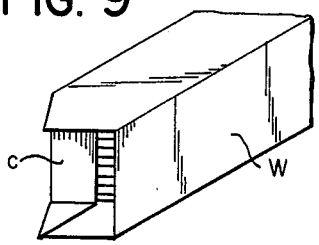
FIG. 10
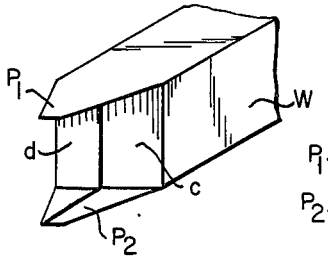
FIG. 11
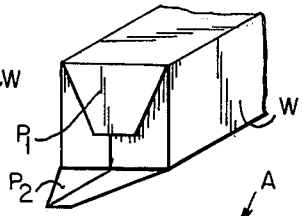
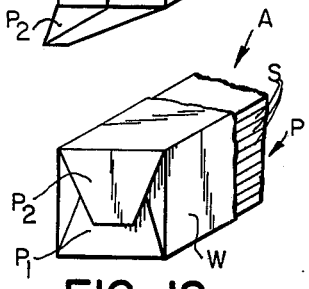
FIG. 12
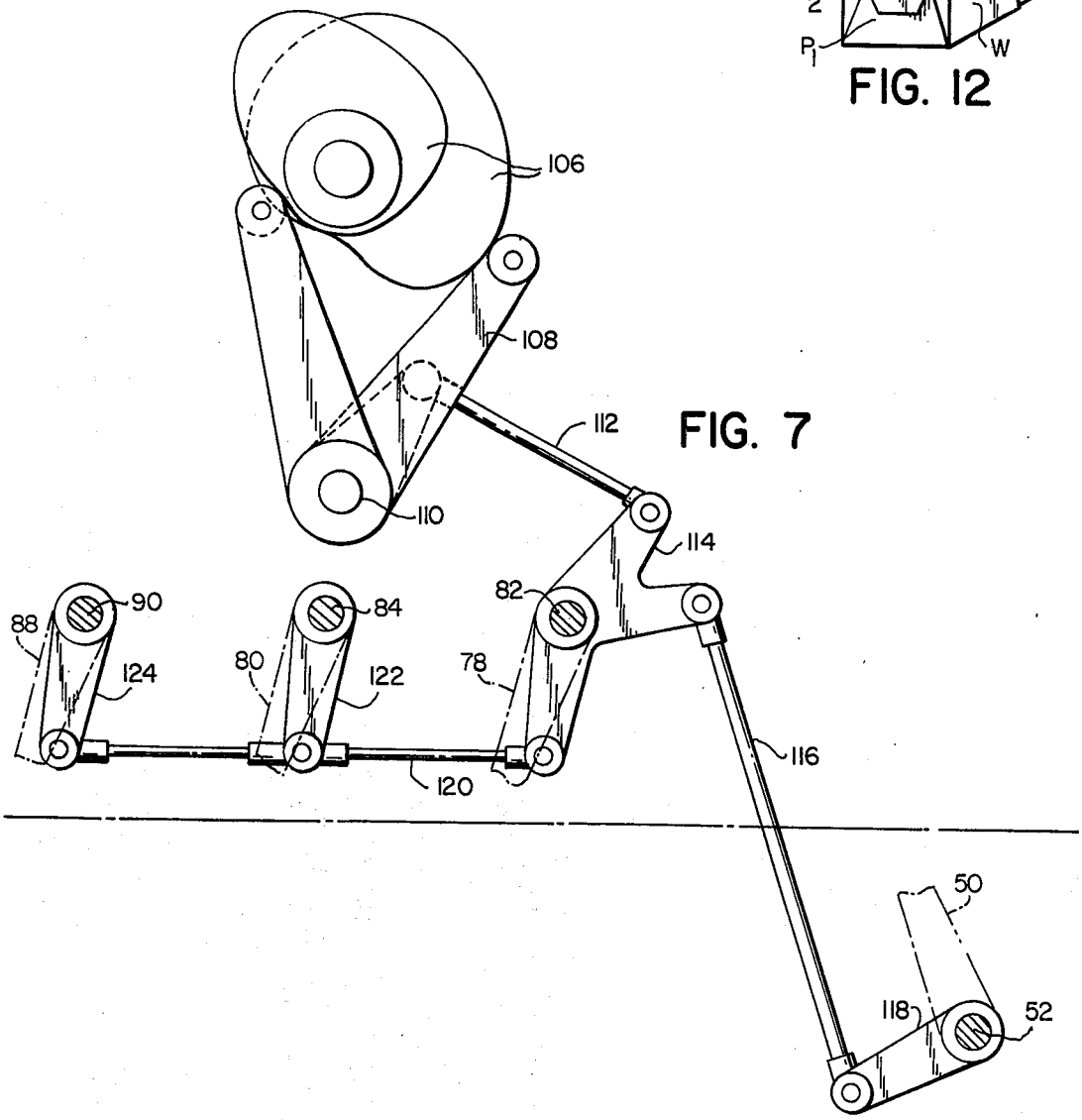
FIG. 7

DRIVE

WRAPPING MACHINE

CROSS REFERENCE TO RELATED APPLICATION

This application is a continuation-in-part of application Ser. No. 606,236, filed Aug. 20, 1975, now abandoned.

BACKGROUND OF THE INVENTION

This invention relates in general to package wrapping machinery and deals more particularly with improvements in machines for wrapping articles of generally rectangular parallelepiped form wherein wrapper folding operations are performed while an article and its wrapper are conveyed along a generally predetermined path by a plurality of tumble boxes.

In forming a package of the aforedescribed general type it is advantageous to perform wrapper folding operations while the article is held square within a tumble box. Heretofore wrapping machines have been provided wherein some initial folding operations have been performed while an article is held in or transferred into a tumble box. However, the article ejector mechanism on tumble boxes heretofore available have imposed limitations on the positioning of end folding and tucking plates, essential to the completion of wrapper end forming operations. As a consequence of the aforesaid limitation, in wrapping an article some of the folding operations necessary to complete the package are performed by plows or the like while the partially wrapped article is advanced through the machine and held square only by line pressure exerted by adjacent articles or by pressure exerted by a pusher, where individual articles are conveyed by transfer machanism. Accordingly, it is the general aim of the invention to provide an improved wrapping machine of the afore-described general type wherein the wrapper end folding operations are performed while the article and its wrapper are held substantially square by a tumble box.

When the wrapping material is of a heat sealable type, as, for example, a wax coated paper, a wrapping machine may be provided with a long seam heater wherein the long seam of the wrapper is sealed. In such a machine it is generally necessary to provide means for preventing overheating of the packages within the long seam heater when the machine is stopped for any reason. A machine of the present invention is also provided with an improved long seam heater.

SUMMARY OF THE INVENTION

In accordance with the present invention improved machines are provided for wrapping articles of a generally rectangular parallelepiped form and which include a plurality of improved rotary tumble boxes which cooperate to perform final wrapper end forming operations required to form a complete package. Each of said improved tumble boxes has a pair of diametrically opposite generally radially outwardly opening article receiving pockets and an ejector mechanism which includes a plunger assembly for ejecting an article and its wrapper from an associated pocket. The ejector mechanism also includes a single plunger operating member which is supported intermediate its ends on the tumbler box to pivot about an axis intermediate the pockets. The operating member has an inner end portion which operably engages the plunger assembly intermediate its ends and within the tumbler box and a free outer end portion which extends outwardly beyond the tumble box. A drive member, which also comprises a part of the ejector mechanism, is supported on the machine for engaging and moving the free end portion of the plunger operating member to move the plunger assembly to an article ejecting position when each pocket is moved to its article discharging position by the tumble box. When the wrapper material is of a heat sealable type the machine may be provided with an improved seam heater which has a heating unit for sealing a seam of the package as the article and its wrapper passes therethrough and which includes automatic means for dumping a partially wrapped article therefrom when the machine stops, for any reason.

BRIEF DESCRIPTION OF THE DRAWINGS

FIG. 7 is a sectional view taken generally along the line 7, 7 of FIG. 5.

FIGS. 9–12 are fragmentary perspective views further illustrating successive wrapping operations performed by the machine of FIGS. 1 and 2.

DETAILED DESCRIPTION OF PREFERRED EMBODIMENT

Figure 1:
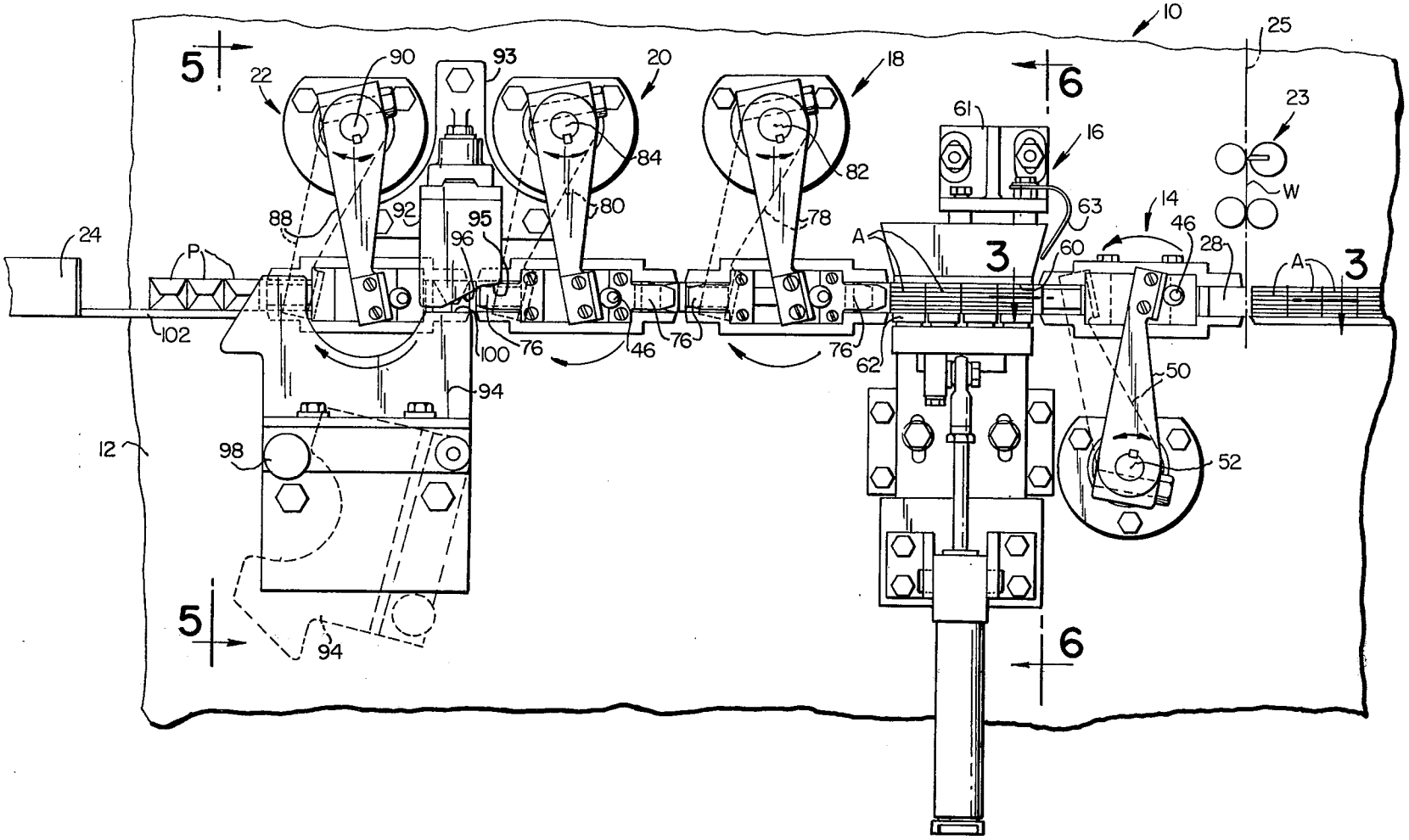
FIG. 1 is a fragmentary side elevational view of a wrapping machine embodying the present invention.
Figure 2:
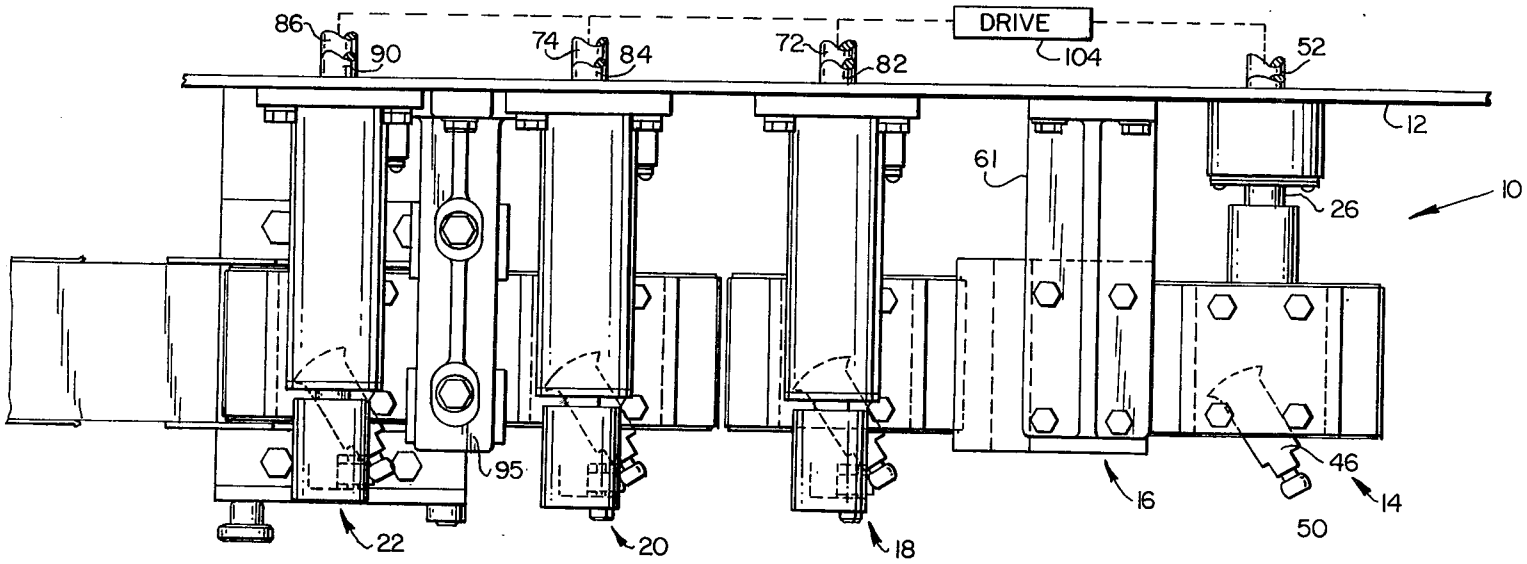
FIG. 2 is a fragmentary plan view of the machine of FIG. 1.

Referring now to the drawings, a wrapping machine illustrating the present invention and indicated generally by the reference numeral 10 in FIGS. 1 and 2 is particularly adapted to package gum sticks arranged in stacked relation, but it will be understood that without substantial modification the machine 10 may be readily adapted to wrap other articles of generally rectilinear parallelepiped form. A portion of a typical package, wrapped by the machine 10 and indicated generally by the letter P in FIG. 12, comprises a stack of individually wrapped gum sticks S, S and an outer wrapper W, preferably formed from heat sealable material. The package P has double point end folds at opposite ends thereof, as will be hereinafter further discussed, the points of the end folds being indicated at $P_1$ and $P_2$, respectively, in FIG. 12. In the description which follows, for convenience, the stack of individually wrapped sticks S, S is collectively designated an article and indicated generally by the letter A.

Further referring to FIGS. 1 and 2, the machine 10 has a frame which includes a vertically disposed plate 12. A first rotary tumble box indicated generally at 14, a long seam heater designated generally by the numeral 16, and second, third and fourth rotary tumble boxes indicated generally at 18, 20 and 22, respectively, are supported in horizontal series on the plate 12. A wrapper feed machanism shown in FIG. 1 and designated generally at 23, which may comprise part of the machine 10 or part of an associated web feed apparatus, severs each wrapper W from an associated web 25 and feeds it into the path of an article A advanced from an associated stick wrapping machine or the like (not shown) toward and into the machine 10. The first tumble box 14 receives an article A and its wrapper W and performs the initial wrapper folding operations. The long seam heater 16 receives the partially wrapped article from the first tumble box 14 and cooperates therewith to form a long seam of the wrapper W which it also seals. The tumble boxes 18, 20 and 22 respectively, successively receive the partially wrapped article A after it leaves the long seam heater 16 and complete the wrapper end tucking and folding operations as the article A and its wrapper W are conveyed from right to left through the machine 10, as it appears in FIGS. 1 and 2, to an end seal heater 24 at the discharge end of the machine, as will be hereinafter more fully discussed.

Figure 3:
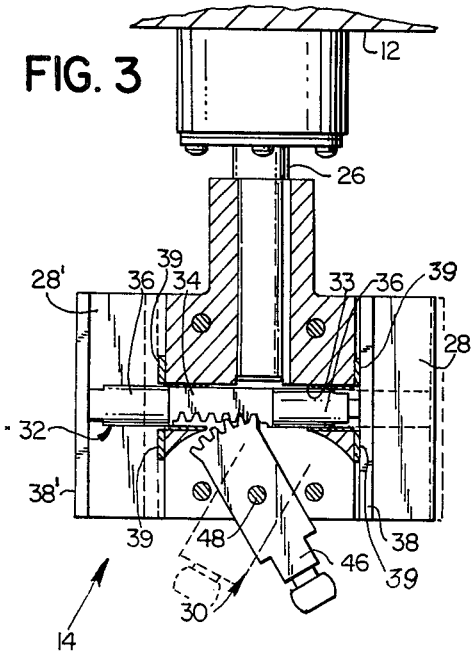
FIG. 3 is a somewhat enlarged fragmentary sectional view through a typical tumble box taken along the line 3, 3 of FIG. 1.
Figure 4:
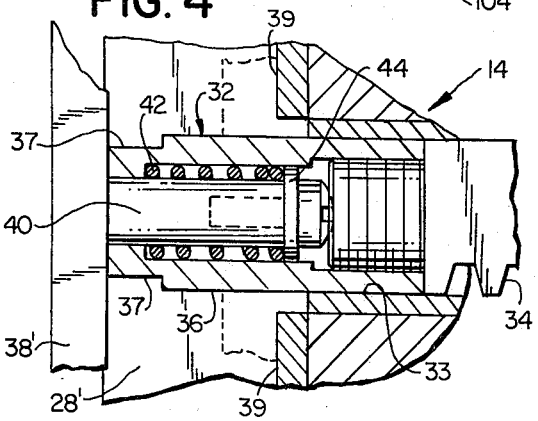
FIG. 4 is a somewhat further enlarged fragmentary view of the tumble box of FIG. 3.

Considering now the machine 10 in detail and referring further to FIGS. 3 and 4, the tumble box 14 is carried by a horizontal shaft 26 journalled for rotation on the plate 12 and projects frontwardly therefrom. It is symmetrical about an axial plane and has diametrically opposite radially outwardly opening article receiving pockets or receptacles 28, 28'. The tumble box 14 has an article ejector mechanism indicated generally at 30 which includes a plunger assembly designated generally at 32 and slidably received in a bore 33 which extends diametrically through the tumble box 14 between the pockets 28, 28'. The plunger assembly 32 comprises a central rack 34 and tubular end parts 36, 36 threadably connected to opposite ends of the rack, as best shown in FIG. 4. Wrench flats 37, 37 at the outer ends of each end part 36 facilitate connection of the end part with an associated end of the rack 34. Ejector plates 38, 38' are mounted at opposite ends of the plunger shaft 32. Each of the plates 38, 38' are movable within an associated pocket 28, 28' and has a shank 40 coaxially received in an associated tubular end part 36, as shown in FIG. 4. A spring 42 surrounds the shank 40 and acts between the tubular end part 36 and a washer 44 fastened to the inner end of the shank 40 to bias an associated ejector plate inwardly in the direction of the rack 34. An operating member or gear segment 46 pivotally supported on the tumble box 14 by a pin 48 operably engages the rack 34 within the tumble box 14, as shown in FIG. 4. As viewed from above in FIG. 3 the segment 46 pivots about an axis normal to the axis of the shaft 26. When the segment 46 is rotated in a counterclockwise direction from its broken line to its full position of FIG. 3 the ejector plate 38' at the left end of the tumble box 14 moves from its broken line or article admitting position to its full line or article ejecting position whereas the ejector plate 28 at the right end of the tumble box moves to its full line or article admitting position. In its article admitting position each ejector plate 38, 38' is wholly disposed within the confines of an associated article receiving pocket 28, 28' and at least partially defines the inner end wall an associated article receiving pocket.

The ejector machanism 30 further includes an ejector drive lever 50, shown in FIG. 1, keyed to the forward end of a shaft 52 journalled on the plate 12 and projecting forwardly therefrom below and parallel to the shaft 26. The upper or free end of the lever 50 carries a bearing plate made from low friction material for engaging a parti-spherical bearing surface on the free end of the segment 46. Drive mechanism located at the rear of the plate 12 drives the lever 50 through the shaft 52 to move the segment 46, as will hereinafter discussed.

Figure 5:
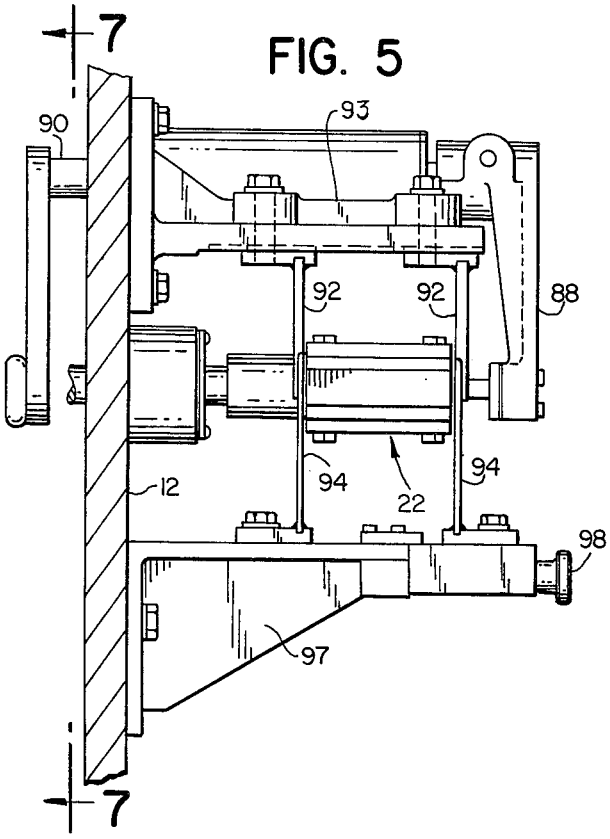
FIG. 5 is a section view taken along the line 5, 5 of FIG. 1.
Figure 6:
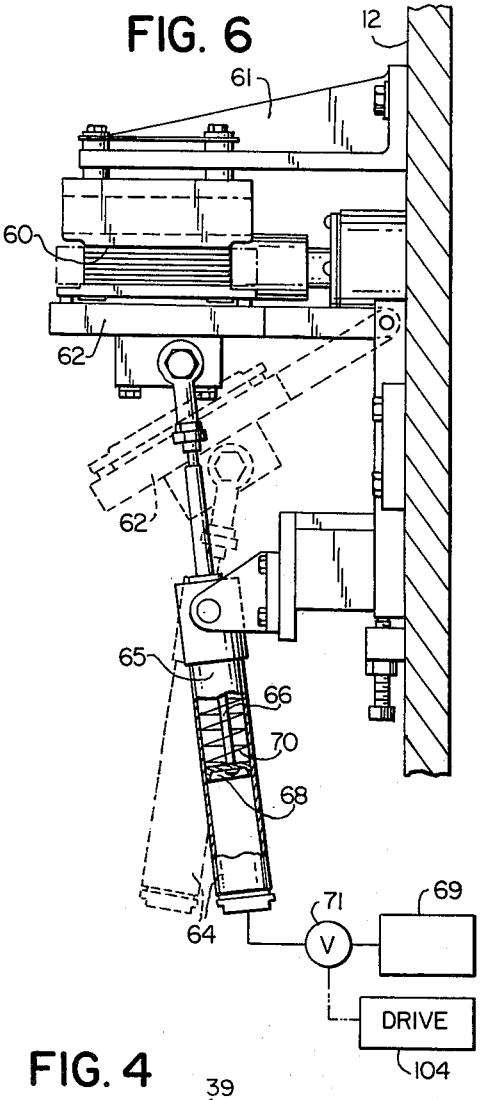
FIG. 6 is a fragmentary sectional view taken along the line 6, 6 of FIG. 1.

Referring now particularily to FIGS. 1, 5 and 6, the long seam heater 16 comprises an upper member or heater plate 60 and a lower article support member 62 which cooperate to define a horizontal path of article travel between the first tumble box 14 and the second tumble box 18, as best shown in FIG. 1. The upper plate 60 has a heating element (not shown) for maintaining the lower wrapper engaging surface of the plate at a predetermined sealing temperature and is supported in fixed position relative to the plate 12 by a bracket mounted 61 which also carries a folding plate 63. The lower article support member 62 comprises a plate which carries a series of article support pads which are spring biased in the direction of the upper plate 60. The lower article support member 62 is hingedly connected to the plate 12 to pivot about a horizontal axis between article supporting and article dumping positions indicated in full and broken lines, respectively, in FIG. 6. A fluid motor or pneumatic cylinder 64 maintains the support member 62 in its article supporting position and has a cylinder part 65 pivotally mounted on a bracket secured to the plate 12 and a piston rod 66 which carries a piston 68. The piston rod 66 projects upwardly from the cylinder part 65 and is pivotally connected at its upper end to the member 62. A compression spring 70 acts between the piston 68 and the cylinder 65 to bias the article support member 62 toward its dumping or broken line position of FIG. 6. Fluid pressure within the cylinder 65 acts upon the piston 68 to maintain the support member 62 and its article supporting position. The cylinder 65 is connected to a source of fluid under pressure 69 through a control valve 71 connected to the drive unit for the machine 10, as will be hereinafter further discussed.

The second and third tumble boxes 18 and 20 perform end tucking operations on extending end marginal portions of the wrapper W as the partially wrapped article is conveyed through the machine 10 and are supported for rotation by drive shafts indicated at 72 and 74, respectively, journalled on the plate 12, as shown in FIG. 2. The tumble boxes 18 and 20 are substantially identical in most respects to the tumble box 14, previously described, and each includes a pair diametrically opposite article receiving pockets 28, 28' and an ejector mechanism 30. However, the latter two tumble boxes differ from the tumble box 14 in that each of the latter tumble boxes has tucking plates 76, 76 secured to its opposite ends which generally define end walls of the pockets 28, 28' formed therein. Each tucking plate 76 extends radially outwardly and has upper and lower edges spaced vertically inwardly of the upper and lower walls of an associated article receiving pocket 28. The upper and lower edges of each plate 76 at its free or outer end are slightly tapered toward each other and in the direction of the open end of the pocket. The segments 46, 46 associated with the tumble boxes 18 and 20 are operated by ejector levers 78 and 80, respectively, mounted on shafts 82 and 84 disposed above and in generally parallel relation to the tumble box shafts 72 and 74.

The fourth tumble box 22 is substantially identical to the first tumble box 14 and is supported for intermittent rotation by a shaft 86 journalled on the plate 12. An ejector drive lever 88 for operating the segment 46 associated with the tumble box 22 is mounted on a shaft 90 above the tumble box 22 and substantially parallel to the shaft 86. A set of stationary folding plates which includes first and second end folding plates indicated, respectively, at 92, 92 and 94, 94 are mounted in fixed position on the plate 12 adjacent the front and rear ends of the tumble box 22, substantially as shown in FIGS. 1 and 5. The first end folding plates 92, 92 are mounted on a bracket 93 attached in fixed position to the frame 12 and depend from the bracket at opposite ends of the tumble box 22 generally adjacent, the pocket 28 at the receiving or loading end of the tumble box. Each plate 92 has a wrapper engaging edge which includes a horizontally disposed portion 95 generally horizontally aligned with the upper wall surface of the pocket 28' at the article discharging end of the tumble box 22 and an inclined portion 96 which is inclined upwardly and in a direction opposite to the direction of article advance. The second end folding plates 94, 94 are supported on a mounting bracket 97 attached to the frame 12 and project upwardly from the bracket generally adjacent the front and rear ends of the tumble box 22, as best shown in FIG. 5. The front end folding plate 94 is mounted on the bracket 97 to pivot between an active or full line position and an inactive or broken line position shown in FIG. 1. A latch pin 98 releasably retains the front folding plate 94 in its active or full line position of FIG. 1. Each of the folding plates 94, 94 has a generally horizontally disposed wrapper engaging surface 100 generally horizontally aligned with the lower wall surface of the pocket 28 at the article receiving end of the tumble box 22 as shown in FIG. 1. A substantially horizontally disposed plate 102 mounted in fixed position relative to the plate 12 at the discharge end of the tumble box 22 receives wrapped articles ejected therefrom. The end seal heater 24 is of a generally convention type and may comprise a part of the machine 10 or a part of another machine associated therewith.

The drive mechanism for the machine 10 includes a drive motor 104 operably connected to the drive shafts 26, 72, 74 and 86 to simultaneously intermittently rotate each of the tumble boxes 14, 18, 20 and 22 through an angle of 180° and in directions indicated by directional arrows in FIG. 1. The mechanism for driving the extractor levers is illustrated somewhat schematically in FIG. 7 and includes a conjugate cam 106 operably connected to the drive motor 104 to drive the various extractor levers in timed relation with the movement with the tumble boxes. More specifically, the ejector drive mechanism includes an ejector cam lever 108 mounted on a rock shaft 110 and connected by a link 112 to a bell crank 114 mounted on the shaft 82 at the rear of the plate 12. A link 116 connects the bell crank 114 to another lever 118 mounted the rear end of the shaft 52 which drives the ejector lever 50. Another link 120 connects the bell crank 114 to levers 122 and 124 mounted on the rear of the ejector drive lever shafts 84 and 90, respectively.

Figure 8:
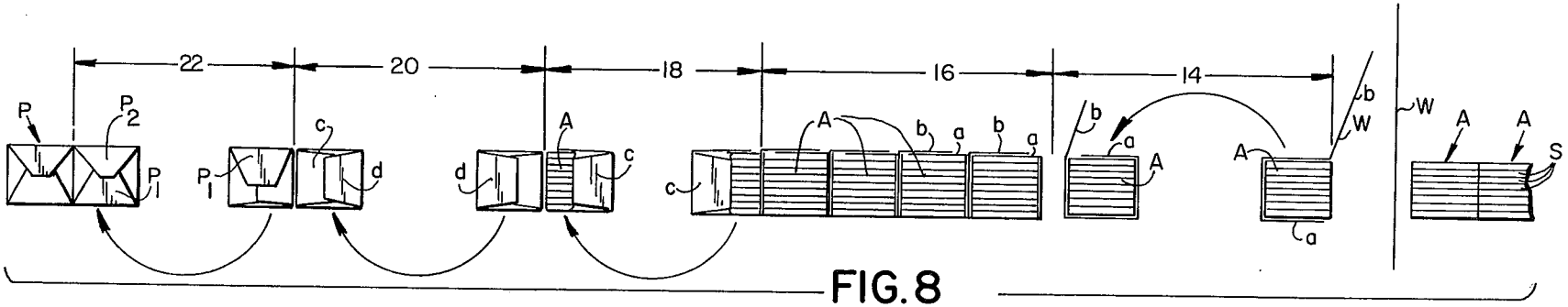
FIG. 8 is a side elevational view diagramatically illustrating successive wrapping operations performed by the machine of FIGS. 1 and 2.

Considering now the operation of the machine 10 and referring particularly to FIGS. 1 and 8, in FIG. 1 the machine is shown after it has completed several operating cycles. Each tumble box is in its article receiving position with the ejector plate 38 at the right end thereof in its article admitting position, as shown in full lines in FIG. 1. It will be noted that the long seam heater 16 contains a full charge of partially wrapped articles A, A and each of the tumble boxes 18, 20 and 22 contain a single partially wrapped article A. Since the wrapping operation is continuous the tumble box 14 at the right end of the machine 10, as it appears in FIG. 1, would also normally contain an article A and its wrapper W. However, for convenience in describing the operation of the machine the article receiving pocket 28 at the right side of the tumble box 14 is shown in an empty condition to better illustrate operation of the wrapper feed mechanism 23.

Articles A, A to be wrapped are advanced in line form right to left and toward the machine 10 from another wrapping machine or the like and in timed relation with the operational cycle of the machine 10. As each successive article is advanced, the wrapper feed mechanism 23 severs a wrapper W of proper length from the web 25 and feeds it into the path of an advancing article A. As the lead article A enters the first tumble box 14 it carries with it a wrapper W and partially forms the long folds of the wrapper. As the article A and its wrapper W enter the tumble box 14 the lower portion of the wrapper is formed to a generally U-shaped configuration around the article A which brings the lower marginal portion of the wrapper designated by the letter (*a*) into face-to-face relation with the lower surface of the article A and the upper end portion of the wrapper designated by the letter (*b*) into trailing relation with the article. While the article A and its wrapper W are moving into the pocket 28 at the right side of the tumble box 14 the ejector drive mechanism operates to move the ejector lever 50 from its full to its broken line position of FIG. 1. When the partially wrapped article A is fully received within the pocket 28 the drive mechanism rotates the tumble box 14 in a counterclockwise direction through an angle of 180° to its article discharging position to carry the article A and its wrapper to a position at the left side of the tumble box. As the article A is moved to the latter position the folding plate 63, mounted on the long seam heater 16, engages the wrapper trailing portion (*b*) to fold the wrapper into engagement with the fourth side of the article, substantially as shown in FIG. 8. The ejector lever 50 now moves from its broken line to its full line position to pivot the segment 46 in a counterclockwise direction, as viewed from above (FIG. 3.). The segment 46 (tumble box 14) moves the ejector plate 38' at the left side of the tumble box to its article ejecting position which moves the partially wrapped article A into the long seam heater 16. The spring loaded plunger assembly 32 facilitates ejector plate overtravel to assure positive article ejection from the tumble box 14. Referring to FIG. 4, when the ejector plate 38 at the right side of the tumble box attains its article receiving position the plate 38 engages stops 39, 39, however, the compression spring 42 associated therewith allows the segment 46 to drive the opposite ejector plate 38' at the left end of the tumble box outwardly beyond the outer edges of its article receiving pocket 28'. This over-travel assures positive ejection of the article from its article receiving pocket and provides clearance between the trailing portion of the ejected article and the tumble box 14. After the article has been ejected from the tumble box 14 the ejector lever 50 returns to the broken line position of FIG. 1. When the ejector lever moves out of engagement with the segment the spring action of the plunger assembly returns the ejector plate 38' at the left side of the tumble box 14 to a retracted position within its associated article receiving pocket 28. It will now be evident that while one article is being ejected from the pocket 28 at the left end of the tumble box 14 and moved into the long seam heater 16 the next successive article A and its wrapper is being loaded into the opposite end of the tumble box 14 in preparation for the next operational cycle.

As the article A and its wrapper move into the long seam heater 16 the wrapper trailing marginal portion (*b*) is folded down against the upper face of the article A and into overlapping relation with the wrapper marginal portion (*a*) whereby the long seam of the wrapper is formed. Each successive article is moved through the long seam heater 16 by line pressure exerted thereon by the next successive article ejected from the tumble box 14. The long seam heater 16, as shown, will accommodate four partially wrapped articles. Thus, each article remains in the long seam heater 16 during four successive cycles of the tumble box 14. This arrangement permits sufficient time for the heated upper plate 60 to transmit sufficient heat to the long seam to heat-seal it.

Each partially wrapped article A is moved by line pressure from the long seam heater 16 into the second tumble box 18. As the partially wrapped article leaves the long seam heater 16 and enters the tumble box 18 the end folding plates 76, 76 engage leading parts of the extending end marginal portions of the wrapper at the opposite ends thereof to form first end tucks. Thus, a part of the extending end marginal portion of the wrapper designated by the letter (*c*) is tucked inwardly against an associated end of the article. An end portion of a partially wrapped article is shown in FIG. 9, as it appears after the first end tuck (*c*) has been formed. The tumble box 18 with the partially wrapped article therein is rotated 180° in a clockwise direction, as viewed in FIG. 1, to its article discharging position to facilitate ejection of the partially wrapped article. Operation of the ejector mechanism moves the ejector lever 78 in a counterclockwise direction from its broken line to its full line position in FIG. 1 which moves the segment 46 associated therewith to eject the article from the tumble box 18 and move it into the third tumble box 20. The latter movement of the tumble box 18 inverts the article and positions the wrapper W relative to the tumble box 20 in preparation for a second end tucking operation. As the partially wrapped article is moved from the tumble box 18 into the tumble box 20 the tucking plates 76, 76 on the tumble box 20 engage leading parts of the extending end marginal portions of the wrapper at the opposite ends thereof to tuck each of these parts inwardly against an associated end of the article and into overlapping relation with a tucked portion (*c*) to form a second tuck indicated by the letter (*d*). In FIG. 10 an end portion of a partially wrapped article is illustrated as it appears after the second end tucking operation has been completed to form the second end tuck (*d*). It should be noted that the points $P_1$ and $P_2$ are formed on each of the wrapper W by the second tucking operation.

The partially wrapped article is once again inverted as the tumble box 20 rotates in a clockwise direction from its article receiving to its article discharging position, as shown in FIG. 1. As the tumble box 20 approaches its article discharging position the projecting points $P_1$, $P_1$ at opposite ends of the partially wrapped article engage the generally horizontally disposed edge portions 95, 95 of the folding plates 92, 92 and are bent downwardly and inwardly around the upper edges of the article and toward the ends of the article which starts square folds, that is folds which are substantially coincident with upper edges of the article. The partially wrapped article is ejected from the tumble box 20 in the manner generally aforedescribed by action of the ejector lever 80 on its associated segment 46. As previously described, the over-travel of the ejector plate 38 assures positive article ejection and provides the necessary clearance between the ejected article and the tumble box to permit the tumble box 20 to rotate in a clockwise direction to return its article receiving position after the partially wrapped article has been ejected therefrom.

As the partially wrapped article A moves into the fourth tumble box 22 the inclined edge portions 96, 96 of the folding plates 92, 92 engage the partially folded points $P_1$, $P_1$ at the opposite ends of the article and further fold them inwardly and into overlapping relation with associated portions of the end tucks (*c*) and (*d*). Referring now to FIG. 11, an end portion of a partially wrapped article is shown after the point fold $P_1$ has been completed by movement of the partially wrapped article A from the tumble box 20 into the tumble box 22. When the partially wrapped article is wholly disposed within the tumble box 22 the end points $P_2$, $P_2$ are generally adjacent to and extend outwardly beyond the edges 100, 100 of the folding plates 94, 94. The partially wrapped article is once again inverted by the tumble box 22 as the tumble box rotates 180 degrees in a clockwise direction from its article receiving to its article discharging position. During the latter movement of the tumble box 22 the edges 100, 100 engage the end points $P_2$, $P_2$ and fold the points inwardly and into overlapping relation with associated portions of the points $P_1$, $P_1$ to complete the package folding operations. The wrapped article is ejected from the tumble box 22 by operation of the ejector lever 88 and moves under line pressure exerted by successively ejected articles into the end seal heater 24 where the ends of the package P are heat sealed in a manner well known in the art.

It should be noted that during the end tucking and folding operations are performed while the partially wrapped article is disposed within or moving into an associated tumble box. As one ejector plate 38' moves toward its ejecting position the ejector plate of the next successive tumble box moves in timed relation to its article admitting position. Because of ejector plate overtravel, hereinbefore described, there will be a small space between each incoming partially wrapped article and the ejector plate immediately ahead of it as the partially wrapped article is moved into a tumble box by the ejector plate of the preceding tumble box. However, it will be evident that the ejector plate ahead of the article and the ejector plate which is moving the article engage opposite sides of the article when the article reaches the end of its travel into the tumble box which receives to, thereby tending to "square" the partially wrapped article within the tumble box. This arrangement assures uniform, well-formed packages.

The machine 10 is provided with a positive drive mechanism, however, when the machine stops or when the power to the drive mechanism is interrupted for any reason the dumping mechanism associated with the long seam heater 16 operates to discharge articles from the long seam heater. This arrangement prevents overheating of packages within the long seam heater 16 in the event of malfunction or if the machine is stopped with partially formed packages in the seam heater. Referring now to FIG. 6, the valve 71 which controls the supply of pressure fluid to the cylinder 65 is interlocked with the drive unit 104 through an appropriate electrical circuit or the like so that interruption of the power to the drive unit causes the control valve 71 to shift to a position wherein the flow of pressure fluid from the supply source 69 to the cylinder 65 is blocked and pressure fluid is exhausted from the cylinder 65. The compression spring 70 then functions to move the piston and piston rod 66 to pivot the lower article support member 62 to its broken line or article dumping position of FIG. 6. Upon restoration of power to the drive unit 104 pressure fluid is again supplied to the cylinder 65 to return the article support plate 62 to and maintain it in its article supporting position.

The pivoted front end folding plate 94, associated with the tumble box 22, facilitates access to the tumble box pockets 28, 28' in the event that an article should jam therein. The pockets of the remaining tumble boxes are readily accessible from the front of the machine 10.

Figures 13, 14, 15, 16:
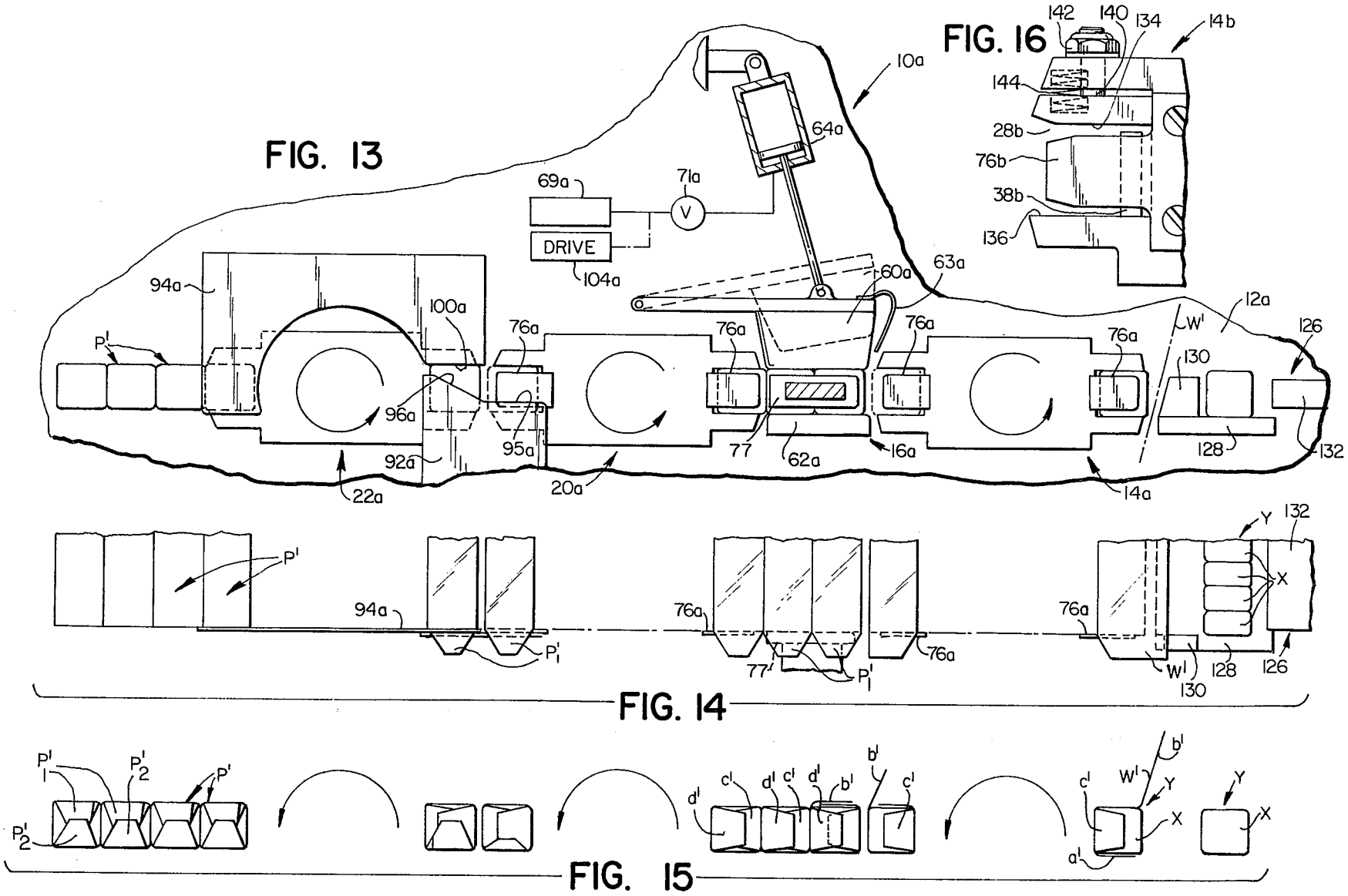
FIG. 13 is a somewhat schematic side elevational view of another wrapping machine embodying the present invention.
FIG. 14 is a somewhat schematic fragmentary plan view diagramatically illustrating successive wrapping operations performed by the wrapping machine of FIG. 13.
FIG. 15 is a side elevational view diagramatically illustrating successive wrapping operations performed by the wrapping machine of FIG. 13.
FIG. 16 is a fragmentary side elevational view of another tumble box.

In FIG. 13 there is shown, somewhat schematically, another machine embodying the present invention, indicated generally at 10*a*, and particularly adapted to wrap a product which comprises a plurality of individual pieces, *x, x* standing on edge and arranged in adjacent end-to-end relation. In the description which follows, and in the claims, the pieces *x, x* best shown in FIG. 14, are collectively designated an article and indicated generally by the letter Y. The machine 10*a* provides end retention for the individual pieces *x, x* which comprise the article Y, as the article and its wrapper, designated W', advance through a folding line which includes a plurality of tumble boxes and a long seam heater. The completed package, indicated at P' in FIGS. 14 and 15, is similar in outward appearance to the package P previously described and has double point end folds at its opposite ends, the points of the end folds being indicated at $P_1'$ and $P_2'$, respectively, in FIG. 15. However, the sequence of folding and tucking operations performed by the machine 10*a* differs somewhat from the folding and tucking sequence of the previously described machine 10, as will be hereinafter further discussed.

Referring particularly to FIG. 13, the machine 10*a* has a vertically disposed frame plate 12*a* and includes a first rotary tumble box indicated generally at 14*a*, a long seam heater generally designated 16*a* and second and third rotary tumble boxes indicated generally at 20*a* and 22*a*, respectively, supported in horizontal series on the plate 12*a*. A wrapper feed mechanism (not shown), which may be similar to the feed mechanism 23 of the previously described embodiment, is also provided for positioning a wrapper W'. The first tumble box 14*a* is identical in most respects to the tumble box 14, previously described, however, it has tucking plates 76*a*, 76*a* secured at its opposite ends. The tucking plates 76*a*, 76*a* are substantially identical to the tucking plates 76, 76, previously described, and define end walls of the article receiving pockets in the tumble box which provide for end retention of the article Y, as will be hereinafter further discussed.

The illustrated long seam heater 16*a* differs considerably from the long seam heater 16 of the previously described embodiment. More specifically, the long seam heater 16*a* comprises an upper member or heater plate 60*a* and a lower article support plate 62 which cooperate to define a horizontal path of article travel between the first tumble box 14*a* and the second tumble box 20*a*, as shown in FIG. 13. The upper plate 60*a* is provided with a heating element (not shown) which maintains the lower wrapper engaging surface of the plate at a predetermined sealing temperature. The upper plate 60*a* is supported on the frame 12*a* to pivot about a horizontal axis between active and inactive positions respectively indicated at full and broken lines in FIG. 13. A fluid motor or pneumatic cylinder 64*a* connected between the upper plate 60*a* and the frame 12*a* is arranged to pivot the upper plate 60*a* to its inactive position out of sealing engagement with an associated partially wrapped article Y in the event of machine stoppage. Suitable controls may be provided and interlocked with the drive mechanism for operating the fluid motor 64*a* to move the upper plate 60*a* to its inactive position in response to machine stoppage. In the illustrated embodiment a valve 71*a* is shown which controls the supply of pressure fluid to the fluid motor 64. The valve 71*a* is electrically connected to the drive unit, indicated at 104*a*, through an appropriate electrical circuit, so that interruption of power to the drive unit causes the control valve 71*a* to shift to a position wherein pressure fluid is supplied to the fluid motor 64*a* from a supply source 69*a* to raise the upper plate 60*a*.

Tucking plates 77, 77, mounted at opposite ends of the long seam heater 16*a* provide end retention of the article Y and form tucks at opposite ends of the wrapper W' as the partially wrapped article is advanced into the long seam heater, as will be hereinafter further discussed.

The second tumble box 20*a* is substantially identical to the tumble box 20. However, it will be noted that the tumble box 20*a* is arranged for rotation in a direction opposite the direction of rotation of the previously described tumble box 20. The tumble box 20*a* has plates 76*a*, 76*a* at its opposite ends, however, the latter plates do not perform a tucking function, but merely serve to retain the ends of partially wrapped packages advanced by the tumble box 20*a*.

The tumble box 22*a* is also substantially identical to the tumble box 22, however, it too is arranged for rotation in a direction opposite the direction of rotation of the corresponding tumble box 22, previously described. Like the tumble box 20, the tumble box 22 is a provided with end folding plates 92*a*, 92*a* and 94*a*, 94*a*, however, the positions of these folding plates are also reversed relative to the corresponding folding plates on the tumble box 22.

Any suitable feed mechanism may be provided for feeding articles into the wrapping machine 10*a*. In the illustrated embodiment, a feed mechanism, indicated generally at 126, comprises an article support plate 128, a pair of end retaining plates 130 (one shown) and a reciprocally movable pusher 132. A group of individual pieces *b, b* which comprise an article Y are moved in the direction indicated by the directional arrow in FIG. 14 and onto the plate 128 ahead of the pusher 132. The pusher operates to advance the article Y between the end retaining plates 130, 130 and into an article receiving pocket at the right-hand side of the tumble box 14*a*, as it appears in FIG. 13. As the article Y is moved toward the tumble box 14*a* by the pusher 132 it picks up a wrapper W' and carries it into the tumble box 14*a*. As the article Y and its associated wrapper W' enter the tumble box 14a the wrapper W' is formed to a generally U-shaped configuration around the article Y which brings a lower marginal portion of the wrapper, designated by the letter *a'*, into face-to-face relation with a lower surface of the article Y and an upper end portion of the wrapper, designated by the letter *b'* into trailing relation with the article Y, as best shown in FIG. 15. Simultaneously, tucking plates 76a, 76a at opposite ends of the tumble box 14a engage a tuck outwardly extending opposite end marginal portions of the wrapper W'. Thus, a part of the extending end marginal portion of the wrapper designated by the letter *c'* is tucked inwardly against an associated end of the article Y as the article and its wrapper move into the first tumble box. When the partially wrapped article Y is fully received within the tumble box 14a the drive mechanism rotates the tumble box 14a in a counterclockwise direction through an angle of 180° to its article discharging position which advances the article Y and its wrapper W' to a position generally adjacent the article receiving end of the long seam heater 16a. As the partially wrapped article moves to the latter position a folding plate 63a mounted on the long seam heater 16a engages the wrapper trailing portion *b'* and folds it against the fourth face of the article. The ejector mechanism associated with the tumble box 14a then operates to move the partially wrapped article Y into the long seam heater 16a which movement forms the long seam of the wrapper and simultaneously forms a second end tuck. More specifically, as the article Y and its associated wrapper W' move into the long seam heater 16a, the wrapper trailing portion *b'* is folded into overlapping relation with the opposite end portion of the wrapper to form the long seam of the wrapper. Simultaneously, the tucking plates 77, 77 at opposite ends of the long seam heater 16a engage associated extending end marginal portions of the wrapper and tuck these marginal portions inwardly against opposite ends of the article Y, this second tuck being indicated at *d'* in FIG. 15. Completion of this second tucking operation also completes points $P_1'$ and $P_2'$ at opposite ends of the wrapper. As previously noted, the plunger assembly which comprises the ejector mechanism on the tumble box 14a is arranged for overtravel to assure positive ejection of the partially wrapped article from the tumble box 14a and to provide clearance between the tumble box 14a and the partially wrapped article which has entered the long seam heater 16a. It will now be evident that while one article and its wrapper is being ejected from the tumble box 14a and moved into the long seam heater 16a by the tumble box ejector mechanism, the next successive article Y and its wrapper W' are being moved into the article receiving pocket at the opposite end of the tumble box 14a by the feed mechanism 126. In FIG. 13 the machine 10a is shown after completion of several operating cycles. Each tumble box is shown in its article receiving position with an article therein. In FIG. 13 a wrapper W' is shown positioned between the feed mechanism 126 and the first tumble box 14a. An article Y is also shown in its position ahead of the pusher 132. It will be understood that the wrapper W' and the article Y will normally be moving to the positions shown in FIG. 13 while the various tumble boxes are in motion, however, for convenience in describing the apparatus the latter positions of the wrapper W' and the article Y are shown.

Each article Y is moved through the long seam heater 16a by line pressure exerted by the next successive article. The illustrated long seam heater 16a can accommodate two articles Y, Y, therefore, each article Y remains in the long seam heater during two successive machine cycles, during which time sufficient heat is applied to the long seam to seal it, in a manner well known in the art.

Each partially wrapped article Y is moved by line pressure from the long seam heater 16a to the second tumble box 20a. Since wrapper end tucking operations have been completed before the partially wrapped article enters the second tumble box 20a, the plates 76a, 76a on the tumble box 20a serve only to retain the previously tucked opposite end portions of the wrapper in engagement with opposite ends of the article Y.

The partially wrapped article Y, now in the tumble box 20a, is once again inverted as the tumble box 20a rotates in a counterclockwise direction from its article receiving position to its article ejecting position of FIG. 13. As the tumble box 20a approaches its article ejecting position projecting points $P_1'$, $P_1'$ at opposite ends of the partially wrapped article engage generally horizontally disposed end portions 95a, 95a of the folding plates 92a, 92a and are bent upwardly and inwardly around the lower edges of the article and toward the ends of the article so that squared end folds are started.

As the partially wrapped article is ejected from the tumble box 20a and moves into the tumble box 22a the inclined edge portions 96a, 96a of the folding plates 92a, 92a engage the partially folded points $P_1'$, $P_1'$ at opposite ends of the article and fold these points inwardly and into overlapping relation with associated portions of the end tucks *c'* and *d'* whereby the first point folds $P_1'$, $P_1'$ are completed. When the partially wrapped article Y is positioned within the tumble box 22a and the end points $P_2'$, $P_2'$, are generally adjacent to and extend outwardly beyond edges 100a, 100a on folding plates 94a, 94a. The final point folding operation to complete the point folds $P_2'$, $P_2'$ is performed when the tumble box 22a rotates in a counterclockwise direction from its article receiving to its article discharging position. During the latter movement of the tumble box 22a the edges 100a, 100a engage the end points $P_2'$, $P_2'$ and fold these points inwardly and into overlapping relation with associated portions of the previously folded points $P_1'$, $P_1'$ which completes the package forming operation. The completed package P' is discharged from the tumble box 22a by the ejector mechanism associated with the tumble box. An appropriate end seal heater (not shown) may be provided for heat sealing the point folds at the opposite ends of the package p', as is well known in the art.

It may be desirable to adapt the machine of the present invention to accommodate articles of more than one size and in FIG. 16 there is shown an improved tumble box which may be adjusted to accommodate articles in a range of sizes. The tumble box of FIG. 16, indicated generally at 14b, is substantially identical, in many respects, to the tumble box 14 previously described and shown in detail in FIGS. 3 and 4. However, the tumble box 14b is provided with adjustable article receiving pockets 28b, 28b (one shown). An article ejector mechanism substantially identical to the mechanism 30 previously described includes an ejector plate 38b which is wholly disposed within the confines of an associated article receiving pocket 28b and which at least partially defines the inner end wall of the latter pocket. The tumble box 14b, as it appears in FIG. 16, has upper and lower walls 134 and 136 which further define the article receiving pocket 28*b*. A plate 138 supported on the tumble box 14*b* defines the upper wall 134 and is adjustable generally toward and away from the stationary lower wall 136. The plate 138 is secured to the body of the tumble box by one or more adjustment screws such as the screw 140 which is carried by the plate and extends through an opening in the body of the tumble box 14*b*. An adjustment nut 142 threadably engages the screw 140 for adjusting the position of the upper wall 134 relative to the lower wall 136. One or more springs, such as the spring 144 acts between the plate 138 and the body of the tumble box 14*b* to bias the plate 138 toward the lower surface 136. The tumble box 14*b* may be provided with end tucking plates 76*b*, as may be required and as shown.

I claim:

1. In a wrapping machine for wrapping an article of generally rectangular parallelepiped form in a protective wrapper and having wrapper forming means for forming a wrapper to a generally U-shaped configuration about an article to bring a portion of the wrapper into overlying relation with two side faces of the article and one marginal portion of the wrapper into overlying relation with at least a portion of a third side face of the article with another marginal portion of the wrapper in trailing relation with an associated side face of the article and end marginal portions of the wrapper extending outwardly beyond the opposite ends of the article, seam forming means for folding the trailing other marginal portion of the wrapper into overlying relation with at least a part of the one marginal portion to form a wrapper seam, and first tuck forming means for tucking a part of each of the extending end marginal portions of the wrapper inwardly against an associated end of the article, the improvement comprising a plurality of rotary tumble boxes including one tumble box for receiving the article and its wrapper from the first tuck forming means and tucking another part of each of the end marginal portions of the wrapper inwardly relative to an associated end of the article, another tumble box for receiving the article and its wrapper from said one tumble box, a set of stationary folding plates mounted in fixed position on the machine immediately adjacent opposite ends of said other tumble box for engaging and folding each of the remaining extending end marginal portions of the wrapper inwardly relative to the ends of the article and into overlying relation with the tucked portions as the article and its wrapper are moved through the machine by said tumble boxes, and means for supporting said tumble boxes on said machine for rotation about parallel axes between article receiving and article discharging positions, respectively, each of said tumble boxes having a pair of a generally diametrically opposite radially outwardly opening article receiving pockets and an ejector mechanism including a plunger assembly supported on said tumble box for reciprocal movement relative to said pockets between article admitting and article ejecting positions, said plunger assembly having article engaging parts at opposite ends thereof, each of said parts being movable relative to an associated one of said pockets and wholly disposed within said one pocket when said one pocket is in its article admitting position, said ejector mechanism including a single plunger operating member supported intermediate its ends on said tumble box for rotation therewith and for pivotal movement about an axis intermediate said pockets, said single operating member having an inner end portion operably connected to said plunger assembly within said tumble box for moving said plunger assembly between said article admitting and article ejecting positions, said single operating member having a free outer end portion extending outwardly beyond said tumble box, said ejector mechanism including a drive member supported on the machine for engaging said free end portion to move said plunger assembly to an article ejecting position relative to one of said pockets when said one pocket is in a discharging position.

2. The combination as set forth in claim 1 wherein said first tuck forming means comprises a tumble box.

3. The combination as set forth in claim 2 wherein said wrapper forming means comprises a tumble box.

4. The combination as set forth in claim 1 wherein said plunger assembly includes a rack and said plunger operating member comprises a gear segment operably engaging said rack.

5. The combination as set forth in claim 4 wherein said drive member comprises a lever for engaging said free end portion.

6. The combination as set forth in claim 4 wherein said plunger assembly includes a plunger shaft defining said rack and each said of parts comprises an ejector plate carried by said plunger shaft.

7. The combination as set forth in claim 6 wherein each said ejector plate is disposed radially outwardly beyond the confines of an associated one of said pockets when said plunger assembly is in its article ejecting position relative to said one pocket and said plunger assembly includes biasing means for resisting the movement of said plunger assembly to an article ejecting position.

8. The combination as set forth in claim 1 wherein said one tumble box has tucking plates mounted thereon at opposite ends thereof, each of said tucking plates extending radially outwardly from said tumble box at an associated end of one of said pockets and generally defining an end wall of said one pocket.

9. The combination as set forth in claim 1 wherein said machine includes a drive unit and said seam forming means comprises a heat sealing unit for receiving the article and its wrapper from the wrapper forming means and having vertically spaced generally horizontally disposed upper and lower members defining a generally horizontally disposed path of article travel through the heat sealing unit and a heating element for maintaining a wrapping engaging surface of one of said members at predetermined sealing temperatures, the further improvement comprising means for hingedly supporting said lower member for movement relative to the upper member between an article supporting position and an article dumping position, means normally biasing said lower member to its dumping position, and means responsive to the condition of said drive unit for maintaining said lower member in said article supporting position when said drive unit is energized.

10. The combination as set forth in claim 9 wherein said lower member is hingedly supported to pivot about a generally horizontal axis.

11. The combination as set forth in claim 9 wherein said means for maintaining said lower member in its article supporting position comprises a fluid motor.

12. The combination as set forth in claim 11 wherein said means normally biasing said lower member comprises a spring.

13. The combination as set forth in claim 11 wherein said fluid motor comprises a pneumatic motor and said biasing means comprises a part of said motor.

14. The combination as set forth in claim 1 wherein each of said tumble boxes has only two pockets.

15. A wrapping machine comprising a plurality of tumble boxes supported for rotation about parallel axes between article receiving and article discharging positions, each of said tumble boxes having only two diametrically opposite generally radially outwardly opening article receiving pockets for receiving an article and its wrapper when each of said pockets is in an article receiving position and having end plates at opposite ends of said pockets for engaging opposite end of a wrapper, each of said tumble boxes having an ejector mechanism including a plunger assembly having article engaging parts movable relative to said pocket between article admitting and article ejecting positions, each of said parts being wholly disposed within an associated one of said pockets in said article admitting position, said ejector mechanism including a single operating member pivotally supported intermediate its ends on said tumble box to pivot about an axis intermediate said pockets and extending in a transverse direction relative to the axis of said tumble box, said single operating member having an inner end portion operably connected to said plunger assembly within said tumble box for moving each of said parts between its article admitting and article ejecting positions and a free outer end portion extending outwardly beyond said tumble box, said ejector mechanism including a drive member mounted on the machine for engaging said free end portion when one of said pockets is in its article discharging position to move said ejector mechanism to its article ejecting position relative to said one pocket.

16. A wrapping machine as set forth in claim 15 wherein said tumble boxes include a first tumble box and wherein said end plates comprise first tuck forming plates mounted on said tumble box to rotate therewith for tucking opposite end portions of the wrapper inwardly against opposite end portions of the article as the article and its wrapper are received within said pocket.

17. A wrapping machine as set forth in claim 16 wherein said machine includes second tuck forming means for receiving the article and its wrapper from said first tumble box and tucking opposite end portions of the wrapper inwardly against opposite end portions of the article and previously tucked portions of the wrapper when the article and its wrapper are ejected from the first tumble box by said ejector mechanism of said first tumble box.

18. A wrapping machine as set forth in claim 17 wherein said second tuck forming means comprises a long seam heater.

19. A wrapping machine as set forth in claim 18 wherein said second tuck forming means comprises tucking plates mounted in fixed position at opposite ends of said long seam heater.

20. A wrapping machine as set forth in claim 17 wherein said tumble boxes include a second tumble box for receiving the article and its wrapper from said second tuck forming means and said end plates on said second tumble box comprise retaining plates for engaging and retaining the previously tucked end portions of the wrapper in engagement with associated end portions of the article.

21. A wrapping machine as set forth in claim 20 wherein said tumble boxes include a third tumble box for receiving the article and its wrapper from second tumble box and said end plates associated with said third tumble box comprise stationary folding plates mounted in fixed position on said machine adjacent opposite ends of said third tumble box for engaging and folding extending marginal end portions of the wrapper inwardly into overlying relation with associated previously tucked end portions of the wrapper.

22. In a wrapping machine having a heat sealing unit for receiving an article and its wrapper and including vertically spaced generally horizontally disposed upper and lower members defining a generally horizontally disposed path of article travel through the heat sealing unit and a heating element for maintaining a wrapper engaging surface of one of said members at predetermined sealing temperature, means for advancing an article and its wrapper along said path and into said heat sealing unit, and drive means for operating said advancing means, the improvement comprising means for hingedly supporting said lower member for movement relative to the upper unit between an article supporting position and an article dumping position, said lower member being normally biased toward its dumping position, fluid pressure responsive means operative in an active condition for maintaining said lower member in said article supporting position, and valve means responsive to the condition of said drive means for supplying fluid under pressure to said fluid pressure responsive means to maintain it in its active condition when said drive means is energized and for exhausting fluid under pressure therefrom when said drive means is deenergized to thereby move said lower member to the dumping position to discharge the articles from said heat sealing unit.

23. The combination as set forth in claim 22 wherein said lower member is hingedly supported to pivot about a generally horizontal axis.

24. The combination as set forth in claim 22 including a spring for biasing said lower member toward its dumping position.

25. The combination as set forth in claim 24 wherein said fluid pressure responsive means comprises a pneumatic motor and said spring comprises a part of said motor.

26. In a wrapping machine, a rotary tumble box having a pair of diametrically opposite generally radially outwardly opening pockets each adapted to receive an article and its wrapper and journalled on the machine to alternately position each of said pockets in article receiving and article discharging positions, respectively, and an ejector mechanism including a plunger assembly carried by said tumble box and supported for reciprocal movement between article admitting and article ejecting positions relative to said pockets, said plunger assembly including a plunger extending through said tumble box between said pockets and having article engaging parts at its opposite ends, each of said parts being wholly disposed within an associated one of said pockets when said plunger assembly is in an article admitting position relative to said one pocket, said ejector mechanism including a single plunger operating member supported intermediate its ends on said tumble box to pivot about an axis intermediate said pockets, said operating member having an inner end portion operably engaging said plunger intermediate its ends and within said tumble box and having a free outer end portion extending outwardly beyond said tumble box, said ejector mechanism including a drive member supported on the machine for engaging and moving said free end portion to move said plunger assembly from an article admitting to an article ejecting position relative to one of said pockets when said one pocket is in its article discharging position.

27. The combination as set forth in claim 26 wherein said plunger includes a rack and said plunger operating member comprises a gear segment engaging said rack.

28. The combination as set forth in claim 26 wherein said drive member comprises a lever for engaging said free end portion.

29. A rotary tumble box as set forth in claim 26 wherein each of said parts comprises an ejector plate disposed radially outwardly beyond the confines of an associated one of said pockets when said plunger assembly is in an article ejecting position relative to said one pocket and said plunger assembly includes biasing means for resisting the movement of said plunger assembly to an article ejecting position.

30. The combination as set forth in claim 26 including means for varying the size of said pockets.

31. The combination as set forth in claim 30 wherein said size varying means comprises a pair of plates, each of said plates defining one wall of an associated one of said pockets and mounted on said tumble box for movement generally toward and away from an opposite wall of said one pocket.

32. The combination as set forth in claim 31 wherein said size varying means includes an adjustment screw for adjustably positioning each plate relative to an associated opposite wall.

33. A rotary tumble box as set forth in claim 29 wherein said biasing means comprises a pair of compression springs and each of said springs acts between said plunger and an associated one of said ejector plates.

* * * * *

UNITED STATES PATENT OFFICE

CERTIFICATE OF CORRECTION

Patent No. 4,073,123 Dated February 14, 1978

Inventor(s) Lawrence W. Schoppee

It is certified that error appears in the above-identified patent and that said Letters Patent are hereby corrected as shown below:

Column 1, line 35, "machanism" should be --mechanism--.

Column 3, line 11, "machanism" should be --mechanism--.

Column 12, line 34, after "22a" delete "and".

Column 12, line 50, "p'" should be --P'--.

Column 15, line 14, after opposite "end" should be --ends--.

Signed and Sealed this

Sixth Day of June 1978

[SEAL]

*Attest:*

RUTH C. MASON
*Attesting Officer*

DONALD W. BANNER
*Commissioner of Patents and Trademarks*